US005462038A

United States Patent [19]

Kotwicki et al.

[11] Patent Number: 5,462,038

[45] Date of Patent: Oct. 31, 1995

[54] AIR/FUEL PHASE CONTROL

[75] Inventors: Allan J. Kotwicki, Dearborn; Paul J. Szuszman, Ann Arbor; Edward L. Christensen, Farmington; Susan J. Lloyd, Ann Arbor, all of Mich.

[73] Assignee: Ford Motor Company, Dearborn, Mich.

[21] Appl. No.: 352,472

[22] Filed: Dec. 9, 1994

[51] Int. Cl.[6] ..... F02D 41/14

[52] U.S. Cl. ..... 123/681; 123/692

[58] Field of Search ..... 123/692, 673, 123/681

[56] References Cited

U.S. PATENT DOCUMENTS 4,703,735 11/1987 Minamitani et al. ..... 123/692

5,074,113 12/1991 Matsuoka ..... 60/276

FOREIGN PATENT DOCUMENTS 60-190631 9/1985 Japan .

*Primary Examiner*—Andrew M. Dolinar

*Attorney, Agent, or Firm*—Allan J. Lippa; Roger L. May

[57] ABSTRACT

An air/fuel control system (8) and method to maintain the air/fuel ratio of each engine bank (28) out of phase with one another. A feedback variable is generated (410–428) in response to a comparison of a difference in exhaust gas oxygen sensors (44, 55) from respective left and right engine banks (56, 57) to a reference (104–120). Separate feedback variables are generated for each engine bank by phase inverting the feedback variable between the banks and adding an adjustment signal (450–462). The adjustment signal is generated from a PI controller responsive to a comparison of the sum of the left and right exhaust gas oxygen sensors (44, 55) to a reference (440–448).

9 Claims, 4 Drawing Sheets

AIR/FUEL PHASE CONTROL

FIELD OF THE INVENTION

The invention relates to air/fuel control systems for V-type engines.

BACKGROUND OF THE INVENTION

It is known to use separate air/fuel feedback control systems for each cylinder bank of a V-type engine. Each air/fuel feedback system adjusts fuel delivered to one cylinder bank in response to a feedback variable derived from an exhaust gas oxygen sensor coupled to that particular cylinder bank. Such a control system results in the air/fuel ratio of each bank oscillating about an average air/fuel ratio which is typically stoichiometry.

Japanese Patent Publication SHO-60-190631 describes a modification of such air/fuel feedback system wherein the air/fuel feedback system of one cylinder bank is slaved to the air/fuel feedback system of the other cylinder bank. Allegedly, the air/fuel oscillations of each bank are thereby forced out of phase to minimize torque fluctuations between the banks.

The inventors herein have recognized and solved numerous problems with the above approaches. One problem is that by slaving the second air/fuel feedback system to the first air/fuel feedback system, the time response and sensitivity of the second air/fuel feedback system are not optimal.

SUMMARY OF THE INVENTION

An object of the invention herein is to operate the air/fuel feedback system of each cylinder bank of a V-type engine 180° out of phase with one another without sacrificing the time response or sensitivity of either feedback control system.

The above object is achieved, and problems of prior approaches overcome, by providing both a control system and method responsive to first and second exhaust gas oxygen sensors each coupled to respective first and second engine banks for maintaining oscillations in air/fuel ratio between the banks in opposite phases. In one particular aspect of the invention, the air/fuel control method comprises: generating a feedback signal from a difference in output signals of the first and second sensors; providing a first adjustment signal and a second adjustment signal from the first and second sensor output signal respectively; creating a first modified feedback signal from a summation of the feedback signal and the first adjustment signal; creating a second modified feedback signal from a summation of the adjustment signal and an inverse of the feedback signal; and adjusting fuel delivered to the first bank by the first modified feedback signal and adjusting fuel delivered to the second bank by the second modified feedback signal.

An advantage of the above aspect of the invention is that the first and second modified feedback signals are forced 180° out of phase with one another to cancel torque fluctuations between the first and second engine banks without reducing the sensitivity or response time of the air/fuel control system.

In another aspect of the invention, the control system comprises: first and second exhaust gas oxygen sensors each communicating with the first and second engine banks, respectively;

first and second exhaust gas oxygen sensors each communicating with the first and second engine banks, respectively;

a first proportional plus integral controller providing a feedback signal in response to a difference in normalized output signals of the first and second sensors;

a second proportional plus integral controller providing a first adjustment signal in response to the first sensor normalized output signal;

a second proportional plus integral controller providing a second adjustment signal in response to the second sensor normalized output signal;

a controller creating a first modified feedback signal from a summation of the feedback signal and the first adjustment signal, the controller creating a second modified feedback signal from a summation of an inverse of the feedback signal and the second adjustment signal; and trimming means for trimming fuel delivered to the first bank in response to the first modified feedback signal and trimming fuel delivered to the second bank in response to the second modified feedback signal to maintain transitions in air/fuel ratio between the first and second banks in phase with one another.

An advantage of the above aspect of the invention is that the air/fuel ratio of each engine bank is maintained 180° out of phase with one another thereby cancelling torque fluctuations between the engine banks while maintaining an optimum response time and sensitivity of the air/fuel control system.

BRIEF DESCRIPTION OF THE DRAWINGS

The object and advantages of the invention described above will be more clearly understood by reading an example of an embodiment in which the invention is used to advantage with reference to the attached drawings wherein.

DESCRIPTION OF AN EMBODIMENT

Figure 1:
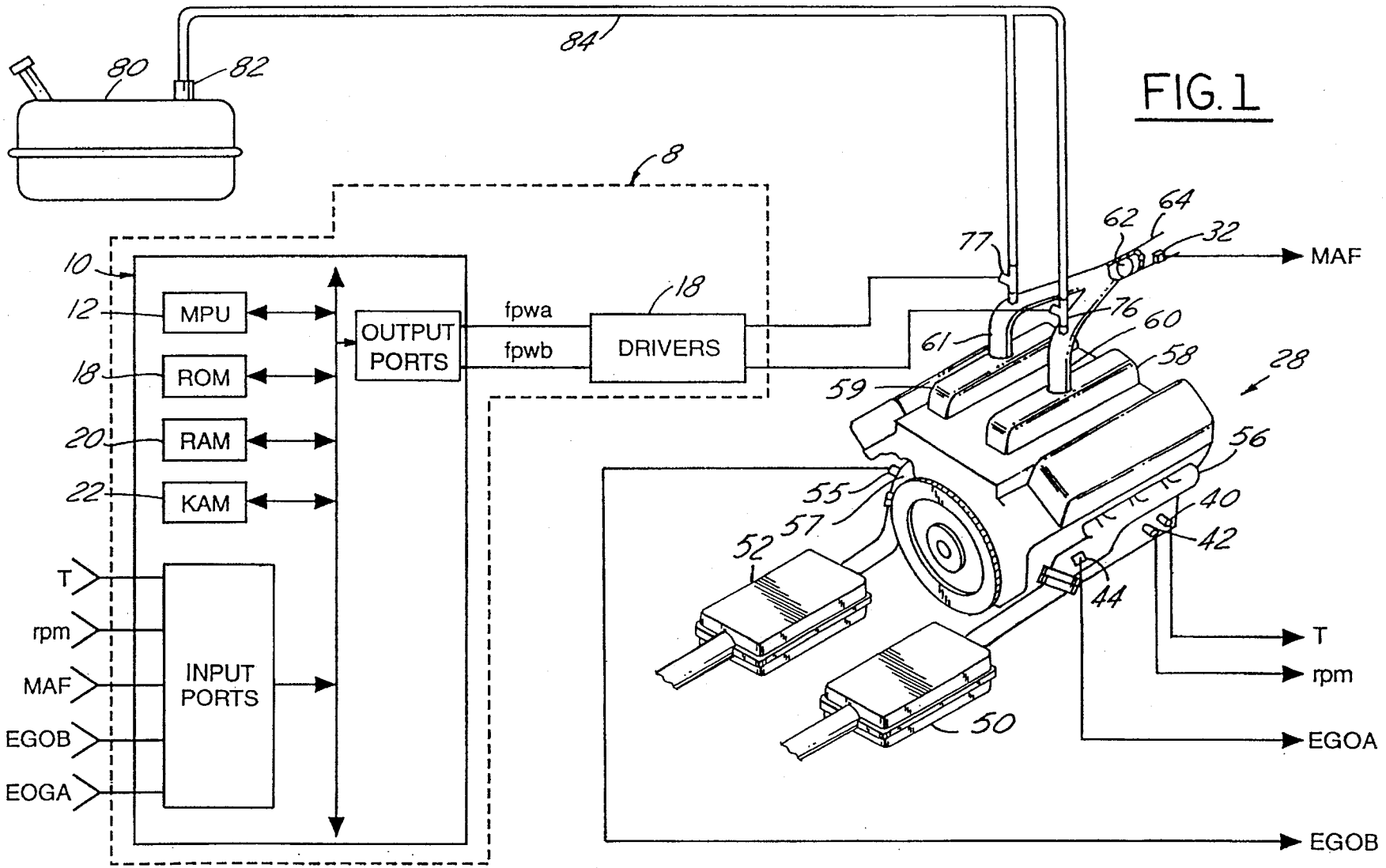
FIG. 1 is a block diagram of an embodiment wherein the invention is used to advantage.

Controller 8 is shown having conventional microcomputer 10 including: microprocessor unit 12; input ports 14; output ports 16; read only memory 18, for storing the controlled program; random access memory 20, for temporary data storage which may also be used for counters or timers; keep alive memory 22, for storing learned values; and a conventional data buss. Outputs of microcomputer 10 are shown coupled to conventional electronic drivers 18.

Various signals from sensors coupled to engine 28 are shown coupled to controller including: measurement of inducted mass air flow (MAF) from air flow sensor 32, engine coolant temperature (T) from temperature sensor 40; and indication of engine speed (RPM) from tachometer 42.

Output signal EGOA is provided from conventional exhaust gas oxygen sensor 44 coupled to right-hand exhaust manifold 56 which, in turn, is coupled to the right-hand cylinder bank of a V-8 engine. Right-hand exhaust manifold 56 is also coupled to catalytic converter 50. Similarly, output signal EGOB is shown provided by conventional exhaust gas oxygen sensor 55 coupled to left-hand exhaust manifold 57. Catalytic converter 52 is coupled to left-hand exhaust manifold 57

Intake manifold 58 and intake manifold 59 are respectively coupled to the right-hand cylinder bank and left-hand cylinder bank of engine 28 and are also shown communicating with respective throttle body 60 and throttle body 61. Each throttle body in turn is shown connected to single air intake 64. Throttle plate 62 and mass air flow sensor 32 are shown coupled to air intake 64.

Continuing with FIG. 1, conventional electronic fuel injectors 76 and 77 are shown coupled to respective throttle body 60 and throttle body 61. Fuel injectors 76 delivers fuel in proportion to the pulse width of signal fpwa from controller 8 via one of the conventional electronic drivers 18. Similarly, fuel injector 77 delivers fuel in proportion to the pulse width of signal fpwb from controller 8 via one of the electronic drivers 18. Fuel is delivered to fuel injectors 76 and 77 by a conventional fuel system including fuel tank 80, fuel pump 82, and fuel rail 84.

Those skilled in the art will recognize that although a central fuel injected (CFI) system is shown for each cylinder bank, the invention claimed herein is also applicable to other fuel delivery systems such as those having a separate fuel injector coupled to each cylinder and carbureted systems. It is also recognized that the invention is applicable to other engine and exhaust gas oxygen sensors such as a separate sensor coupled to a plurality of combustion sensors in an in-line engine. Further, the invention is applicable to sensors other than two-state sensors such as proportional sensors.

Figure 2:
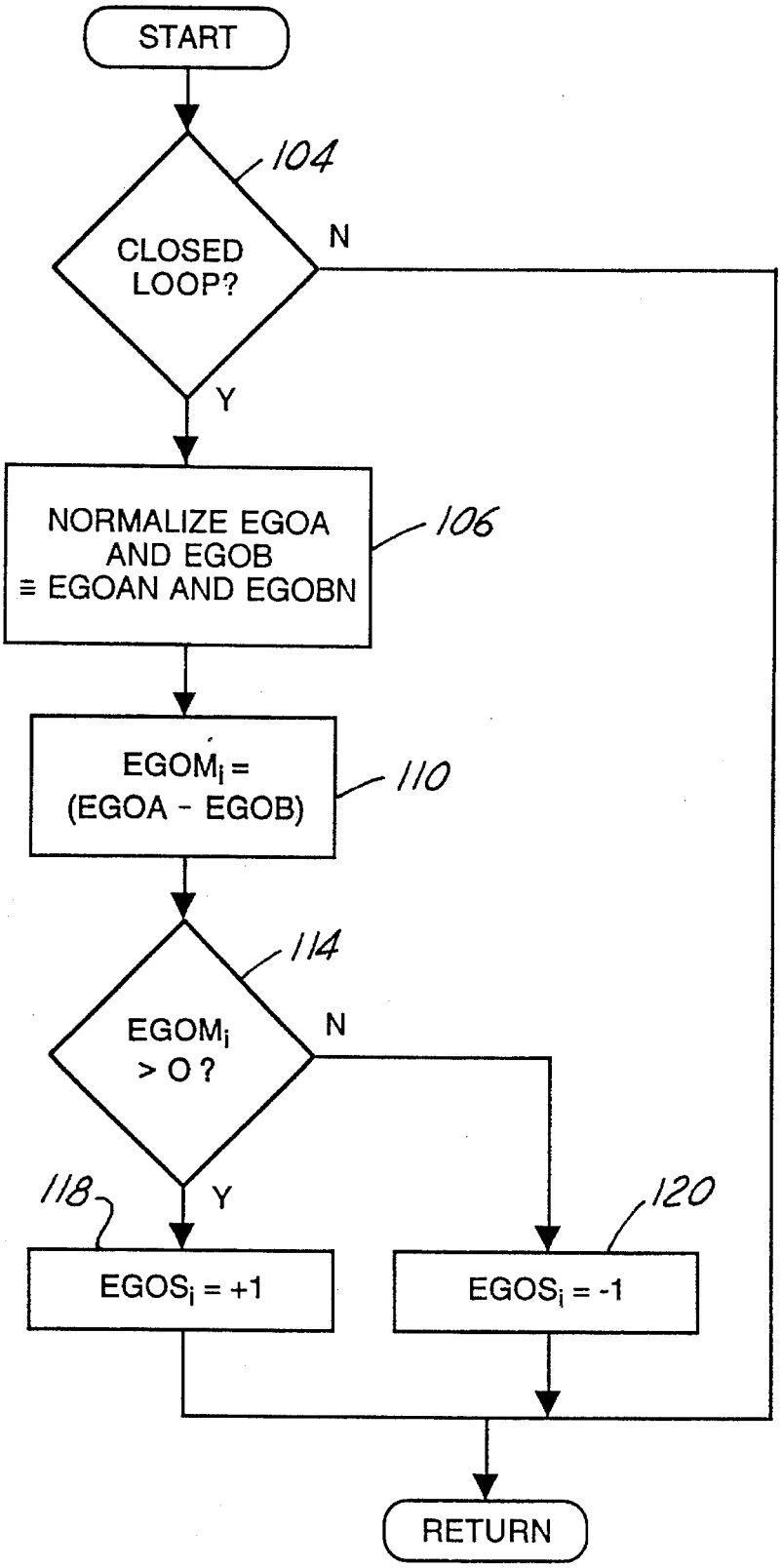
FIGS. 2, 3A–3B, 4–5, and 6A–6B are high level flow charts of various operations performed by a portion of the embodiment shown in FIG. 1.

Referring now to FIG. 2, a flowchart of a routine performed by controller 8 to generate two-state signal $EGOS_i$ each background loop or sample period (i) is now described. The routine is entered after closed-loop air/fuel control is commenced (step 104) in response to preselected operating conditions such as engine temperature. When closed-loop control commences, signal EGOA and signal EGOB from respective exhaust gas oxygen sensors 44 and 55 are sampled and normalized (step 106). After normalization, respective signals EGOAN and EGOBN provide a positive predetermined output state and a negative predetermined output state when exhaust gases are rich or lean of stoichiometry, respectively.

Each sample period (i), signal $EGOM_i$ is generated by subtracting signal EGOBN from signal EGOAN (step 110). When signal $EGOM_i$ is greater than reference value REFB (step 114), signal $EGOS_i$ is set equal to a predetermined positive value such as one volt (step 118). On the other hand, when $EGOM_i$ is less than reference value REFB as shown in step 114, signal $EGOS_i$ is set equal to a negative value such as minus one volt.

Figures 3A, 4:
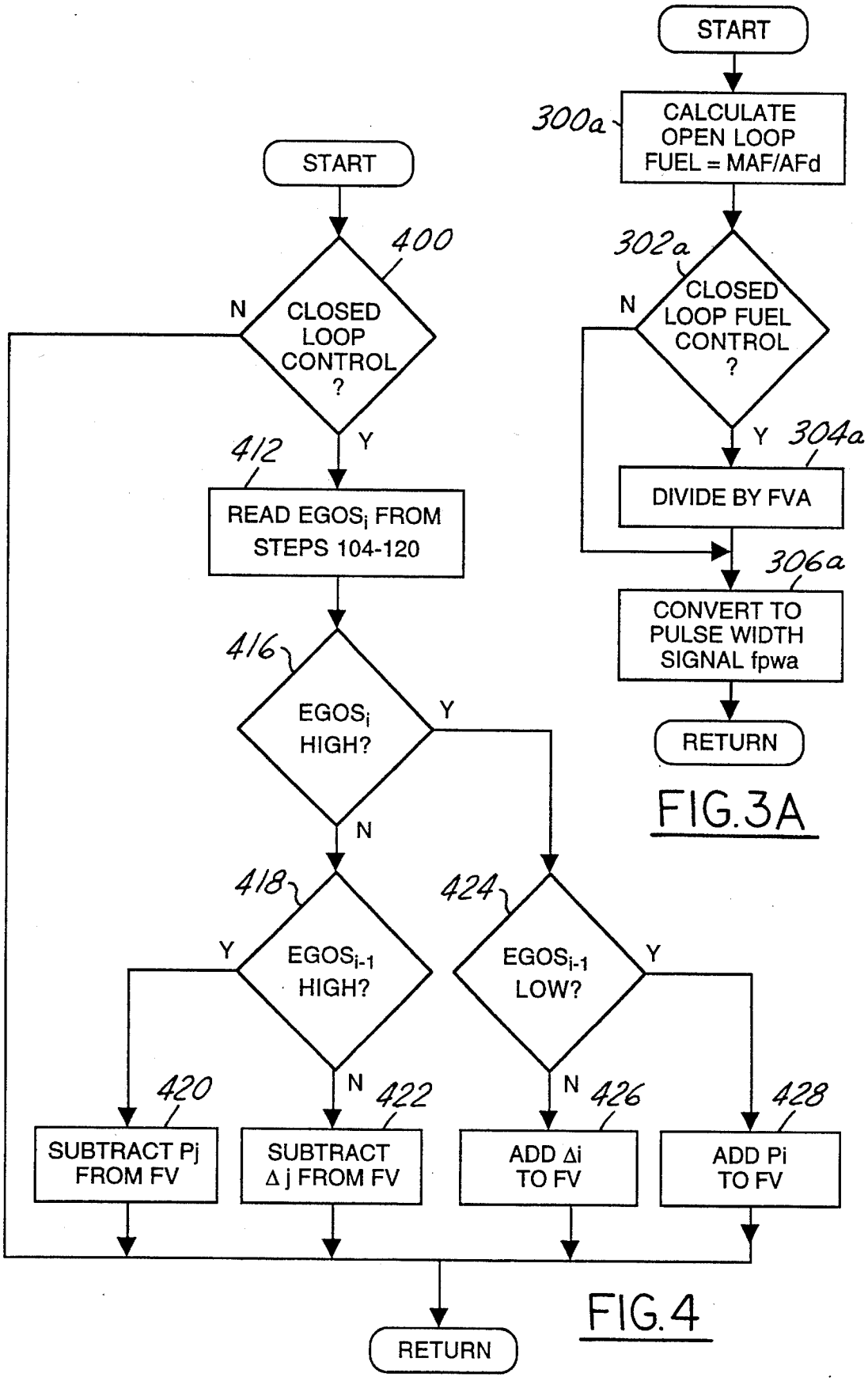
Figure 3B:
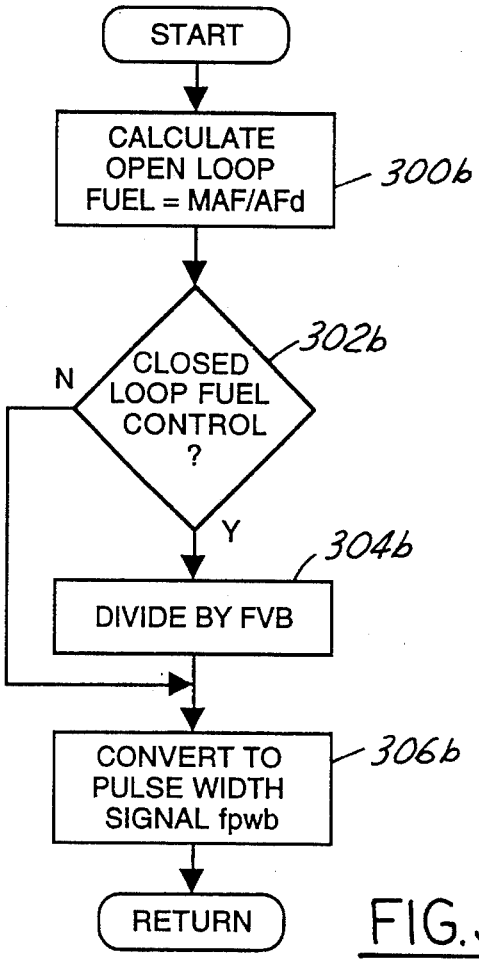

A flowchart of the liquid fuel delivery routine executed by controller 8 for controlling engine 28 is now described beginning with reference to the flowcharts shown in FIGS. 3A and 3B. FIG. 3A describes fuel delivery to the right engine bank of engine 28 and FIG. 3B describes fuel delivery for the left bank of engine 28.

In FIG. 3A, an open-loop calculation of desired liquid fuel is shown calculated in step 300*a*. More specifically, the measurement of inducted mass airflow (MAF) from sensor 32 is divided by desired air/fuel ratio AFd which in this particular example is the stoichiometric air/fuel ratio. After determination is made that closed-loop or feedback control is desired (step 302*a*), the open-loop fuel calculation is trimmed by fuel feedback variable FVA to generate the desired fuel signal during step 304*a*. This desired fuel signal is converted into fuel pulse width signal fpwa for actuating fuel injector 76 (FIG. 1) coupled to the right-hand engine bank.

In a similar matter, fuel pulse width fpwb is generated in FIG. 3B wherein like numerals refer to like steps shown in FIG. 3A. In the routine shown in FIG. 3B, the open-loop fuel calculation is divided by feedback signal FVB to generate fuel pulse width signal fpwb for the left-hand engine bank of engine 28.

In general, feedback signal FVA and feedback signal FVB are each generated from feedback signal FV as described in greater detail later herein with particular reference to FIGS. 6A and 6B. The routine for generating feedback signal FV is now described with reference to FIG. 4.

After closed-loop fuel control is commenced (step 410), signal $EGOS_i$ is read during sample time (i) from the routine previously described with respect to steps 104–120 shown in FIG. 2. When signal $EGOS_i$ is low (step 416), but was high during the previous sample time or background loop (i–1) of controller 8 (step 418), preselected proportional term Pj is subtracted from feedback variable FV (step 420). When signal $EGOS_i$ is low (step 416), and was also low during the previous sample time (step 418), preselected integral term Δj is subtracted from feedback variable FV (step 422).

Similarly, when signal $EGOS_i$ is high (step 416), and was also high during the previous sample period (step 424), integral term Δi is added to feedback variable FV (step 426). When signal $EGOS_i$ is high (step 416), but was low during the previous sample time (step 424), proportional term Pi is added to feedback variable FV (step 428).

Figure 5:
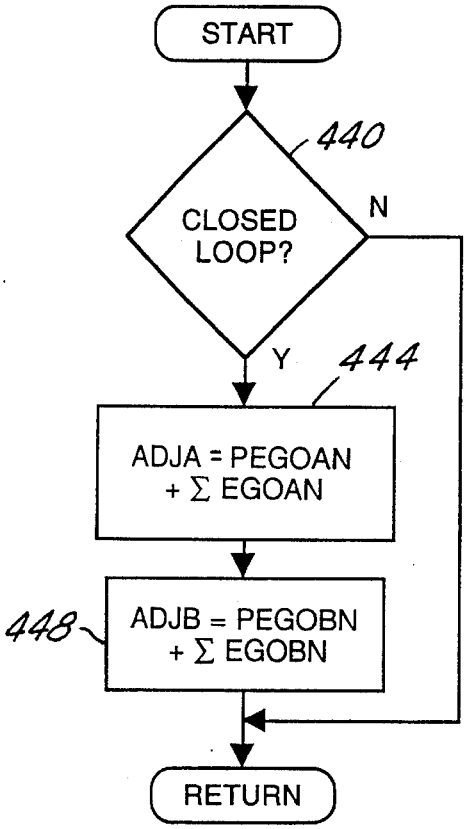

The routine for generating adjustment signal ADJ is now described with reference to the routine shown in FIG. 5. After closed-loop air/fuel control is determined in step 440, adjustment signal ADJA and adjustment signal ADJB are generated for respective right hand and left hand engine banks. Adjustment signal ADJA is generated by processing signal EGOA in a proportional plus integral controller (step 444). More specifically, adjustment signal ADJA is generated by multiplying proportional term "P" times signal EGOAN each sample period (i). The resulting product is then added to the integral of signal EGOAN each sample period (i).

Similarly, adjustment signal ADJB is generated by processing signal EGOBN in a proportional plus integral controller at 448. Each sample period (i), proportional term "P" is multiplied by signal EGOB. The resultant product is then added to the integral of signal EGOBN each sample period (i) as shown in step 448.

Figure 6A:
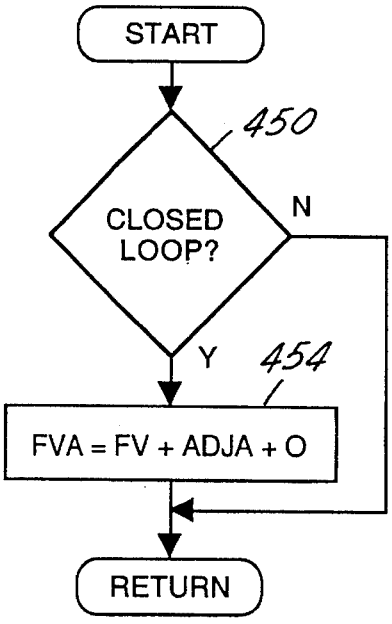
Figure 6B:
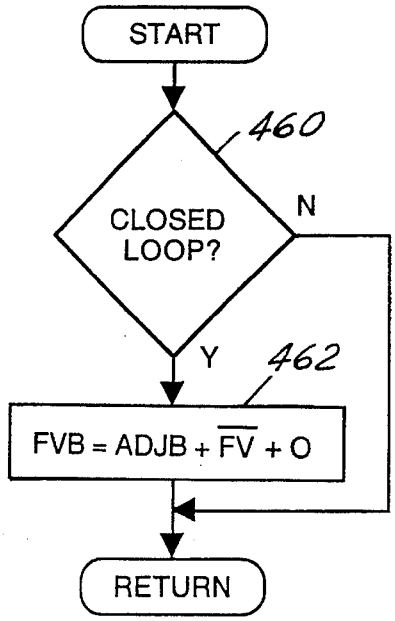

Feedback signal FVA for correcting the right cylinder bank of engine 28 is generated by the routine illustrated in FIG. 6A. More specifically, when controller 8 is in closed-loop fuel control (step 450), feedback signal FVA is generated by adding adjustment signal ADJA to feedback signal FV (step 554). Similarly, feedback signal FVB for the left cylinder bank of engine 28 is generated by the routine shown in FIG. 6B. When closed-loop air/fuel control is commenced (step 460), feedback signal FVB is generated by adding feedback signal $\overline{FV}$ and adjustment signal ADJB.

As discussed previously herein with particular reference to FIGS. 3A, feedback signal FVA trims the open-loop fuel calculation to maintain the right cylinder bank of engine 28 at, on average, a desired air/fuel ratio during closed-loop fuel control. Similarly, as previously described with reference to FIG. 3B, during closed-loop fuel control, feedback signal FVB trims the open-loop fuel delivery calculation to maintain the left cylinder bank at a desired, average air/fuel ratio.

An advantageous effect of the operation described above is that transitions in the air/fuel ratio of each engine bank is operated 180° out of phase with the other thereby minimizing torque fluctuation.

Although on example of an embodiment which practices the invention has been described herein, there are numerous other examples which could also be described. For example, the invention may be used to advantage with carbureted engines proportional exhaust gas oxygen sensors, and engines having an in-line configuration rather than a V-configuration. Further, other combinations of analog devices or discrete IC's may be used to advantage in place of the microcomputer shown. The invention is therefore to be defined only in accordance with the following claims.

What is claimed:

1. An air/fuel control method responsive to first and second exhaust gas oxygen sensors each coupled to respective first and second engine banks for maintaining oscillations in air/fuel ratio between the banks in opposite phases, comprising the steps of:

generating a feedback signal from a difference in output signals of the first and second sensors;

providing a first adjustment signal and a second adjustment signal from said first and second sensor output signals respectively;

creating a first modified feedback signal from a summation of said feedback signal and said first adjustment signal;

creating a second modified feedback signal from a summation of said second adjustment signal and an inverse of said feedback signal; and adjusting fuel delivered to the first bank by said first modified feedback signal and adjusting fuel delivered to the second bank by said second modified feedback signal.

2. The control method recited in claim 1 wherein said fuel adjusting step for said first bank and said second bank are respectively responsive to a measurement of air inducted into the first bank and the second bank.

3. The method recited in claim 1 further comprising a step of normalizing said first sensor and said second sensor output signals.

4. An air/fuel control method responsive to first and second exhaust gas oxygen sensors each coupled to respective first and second engine banks for maintaining oscillations in air/fuel ratio between the banks in opposite phases, comprising the steps of:

normalizing output signals of said first sensor and said second sensor;

generating a feedback signal from a difference in said normalized output signals of the first and second sensors;

providing a first and a second adjustment signal from an integration of said first and second sensor normalized output signals, respectively;

creating a first modified feedback signal from a summation of said feedback signal and said first adjustment signal;

creating a second modified feedback signal from a summation of said second adjustment signal and an inverse of said feedback signal; and adjusting fuel delivered to the first bank by said first modified feedback signal and adjusting fuel delivered to the second bank by said second modified feedback signal.

5. The method recited in claim 4 wherein said step of providing said first adjustment signal further comprises integrating said normalized first sensor output.

6. The method recited in claim 4 wherein said step of creating said first modified feedback signal includes integrating said summation of said feedback signal and said adjustment signal.

7. An air/fuel control system for an engine having first and second engine banks, comprising:

first and second exhaust gas oxygen sensors each communicating with the first and second engine banks, respectively;

a first proportional plus integral controller providing a feedback signal in response to a difference in normalized output signals of the first and second sensors;

a second proportional plus integral controller providing a first adjustment signal in response to said first sensor normalized output signal;

a third proportional plus integral controller providing a second adjustment signal in response to said second sensor normalized output signal;

a controller creating a first modified feedback signal from a summation of said feedback signal and said first adjustment signal, said controller creating a second modified feedback signal from a summation of an inverse of said feedback signal and said second adjustment signal; and trimming means for trimming fuel delivered to the first bank in response to said first modified feedback signal and trimming fuel delivered to the second bank in response to said second modified feedback signal to maintain transitions in air/fuel ratio between the first and second banks out of phase with one another.

8. The control system recited in claim 7 further comprising a fuel controller delivering fuel to said first bank and said second bank in proportion to a measurement of air inducted into the first bank and the second bank.

9. The control system recited in claim 7 wherein said first and said second exhaust gas oxygen sensors each provide an output in a first state when exhaust gases are rich of a desired air/fuel ratio and each provide said output in a second state when exhaust gases are lean of said desired air/fuel ratio.

* * * * *